US006431687B1

(12) United States Patent
Wuu et al.

(10) Patent No.: US 6,431,687 B1
(45) Date of Patent: Aug. 13, 2002

(54) MANUFACTURING METHOD OF MONOLITHIC INTEGRATED THERMAL BUBBLE INKJET PRINT HEADS AND THE STRUCTURE FOR THE SAME

(75) Inventors: Dong-Sing Wuu, Chang-Hua Hsien; Chen-Yu Cheng, Hsinchu; Je-Ping Hu, Lu-Chou; Yi-Yung Wu, Taichung Hsien; Yih-Shing Lee, Tainan, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/813,599

(22) Filed: Mar. 20, 2001

(30) Foreign Application Priority Data

Dec. 18, 2000 (TW) ..... 89127035

(51) Int. Cl.[7] ..... B41J 2/05
(52) U.S. Cl. ..... 347/64
(58) Field of Search ..... 347/64, 54–63, 347/65–85; 216/27, 4, 48; 29/890.1; 430/311

(56) References Cited

U.S. PATENT DOCUMENTS 4,490,728 A 12/1984 Vaught
4,596,994 A 6/1986 Matsuda
4,723,129 A 2/1988 Endo
4,774,530 A 9/1988 Hawkins
4,809,428 A 3/1989 Aden
4,863,560 A 9/1989 Hawkins
5,463,411 A 10/1995 Wehl

*Primary Examiner*—Raguel Yvette Gordon
(74) *Attorney, Agent, or Firm*—W. Wayne Liauh

(57) ABSTRACT

A manufacturing method of monolithic integrated thermal bubble inkjet print heads and the structure for the same. The method utilizes semiconductor manufacturing technologies to configure various elements in a thermal bubble inkjet print head, such as ink channels, an ink slot, an energy transducer, an orifice plate, on a single substrate. The ink channels are formed on an top surface of the substrate using the anisotropic etching technique. The ink slot is formed on a back surface of the substrate using the anisotropic etching technique. The energy transducer and the orifice plate are formed in order above the ink channels using the coating and etching techniques. This thermal bubble inkjet print head manufacturing method is particularly useful in the all batch process without employing the steps of precision alignment joint for the orifice plate in a conventional inkjet print head. Therefore, the method can greatly increase production efficiency and lower production costs.

26 Claims, 8 Drawing Sheets

MANUFACTURING METHOD OF MONOLITHIC INTEGRATED THERMAL BUBBLE INKJET PRINT HEADS AND THE STRUCTURE FOR THE SAME

BACKGROUND OF THE INVENTION

1. Field of Invention

The present invention relates to a method of manufacturing a thermal bubble inkjet print head and the structure for the same. More particularly, the invention relates to a manufacturing method of a monolithic integrated thermal bubble inkjet print head and the structure for the same.

2. Related Art

In the conventional thermal bubble inkjet print head structure, the print heads developed by, for example, Hewlett Packard (the U.S. Pat. Nos. 4,490,728 and 4,809,428), Canon (the U.S. Pat. Nos. 4,596,994 and 4,723,129) or Xerox (the U.S. Pat. Nos. 4,774,530 and 4,863,560) are the side shooting ones as shown in FIGS. 1A and 1B and the roof shooting ones as shown in FIGS. 2A and 2B. FIG. 1B is a cross-sectional view of FIG. 1A in the A–A' direction, and FIG. 2B is a cross-sectional view of FIG. 2A in the B–B' direction. The basic structure of these two types of thermal bubble inkjet print heads contains: an ink channels 1, a nozzle 2 for releasing ink, an orifice plate 3, an energy transducer 10 for converting electrical energy into thermal energy, and protection layers 7, 8 formed above and below the energy transducer 10. The ink channel 1, the nozzle 2, and the orifice plate 3 are all formed on a substrate 4. The energy transducer 10 can be composed of a thermal resistor film 5 and wires 6 in a proper layout. The function principle of the thermal bubble print head is to use the resistor heated energy transducer 10 to heat up the ink in the ink channel 1 and jet out the ink. When printing, the inkjet print head receives a current pulse provided by the printer. The current pulse is transmitted through the wire 6 to the energy transducer 10. Therefore, the energy transducer 10 generates a short high temperature to vaporize the ink. The ink vapor rapidly expands to provide a pressure to jet out the ink droplet from the nozzle 2.

Most of the conventional manufacturing methods for thermal bubble inkjet print head grow a heat insulation layer on a silicon chip, such as $SiO_2$, and then deposit thermal resistant materials and conducting materials by sputtering. Afterwards, the standard integrated circuit manufacturing technologies, such as masking, exposure, developing, and etching, are employed to form an electricity-heat energy transducer and connection wires. Later on, other protection layers and ink channels formed with dry films are provided. Finally, an orifice plate is attached to form an inkjet element. Another conventional method, proposed by Xerox, is to make the ink channels on another silicon chip (different from that with the thin film thermal resistor) and then combine both chips by bonding. However, the above-mentioned conventional method has to separate the inkjet print head into several different pieces and then assemble then together. For example, the chip with the thermal resistor, the orifice plate, and the materials for forming the ink channels are separately made and will be combined together through precision alignment and bonding. Thus, the conventional methods inevitably require high manufacturing costs.

To solve the above defects, Eastman Kodax proposed in the U.S. Pat. Nos. 5,463,411 and 5,760,804 that an anisotropic etched (110) silicon chip can be used to form an ink channel, wherein the micro-channel goes through the whole chip from the chip back. Although this method can be used in forming a monolithic integrated inkjet print head structure, it has to use metal foil on the chip back to make a throttle slit for preventing ink back flows. Furthermore, the method will form bubbles on the micro-channel wall surfaces while anisotropic etching. Therefore, the stability and yield of such manufacturing processes are hard to control.

Therefore, there is a need to develop a new manufacturing method and a structure of a new thermal bubble inkjet print head that can solve the above-mentioned problems.

SUMMARY OF THE INVENTION

It is thus an object of the invention provide a manufacturing method and a structure of a monolithic integrated inkjet print head that only require a simple manufacturing process and lower costs.

Pursuant to the above object, the present invention uses semiconductor manufacturing technologies to configure all elements in a thermal bubble inkjet print head. For example, an ink channels, an ink slot, an energy transducer, and an orifice plate are all finished on the same substrate. This method for making thermal bubble inkjet print heads is particular useful in all batch processes and does not need the step of precision alignment and bonding for orifice plates in conventional methods. Therefore, the present invention can greatly increase the production efficiency and lower the manufacturing costs.

According to the disclosed method, each part in the structure of the inkjet print head is finished on the same substrate. The top side of the substrate has a top surface and the back side has a back surface. The method comprises the following steps: (a) forming a patternized sacrifice layer on the top surface to define an ink channel pattern; (b) forming a first protection layer on the top surface and the sacrifice layer, forming a second protection layer on the back surface, and making a mesh on the first protection layer of the sacrifice layer; (c) etching the sacrifice layer and the top surface of the substrate using the anisotropic etching technology to form the ink channels; (d) forming a planarizing insulation layer on the first protection layer to fill the mesh; (e)forming energy transducers and proper wires corresponding to the ink channels on the planarizing insulation layer; (f) forming an insulation layer on the wires and the energy transducer to protect the wires and the energy transducer; (g) etching at least one ink slot connecting to the ink channels on the back of the substrate; (h) etching proper electrical pads and orifices connecting to the ink channels on the top surface of the substrate; and (i) forming an orifice plate on the top surface of the substrate.

The monolithic integrated inkjet print head structure manufactured according to the above method is not limited by the low resolution of the dry film materials and the electroforming nozzle plate in the prior art. It can further minimize the ink channels and the orifice so as to decrease the volume of ink droplet being jetted out. This helps increase the orifice density and dot per inch (DPI) resolution. The structure is easier to be expanded into a page-wide print head.

Moreover, in the monolithic integrated print head structure, the ink slots and the energy transducers are installed on different surfaces of the substrate and, the transducers and the orifices doesn't need to at the same positions. This helps in the circuit layout for increasing the orifice density.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1B:
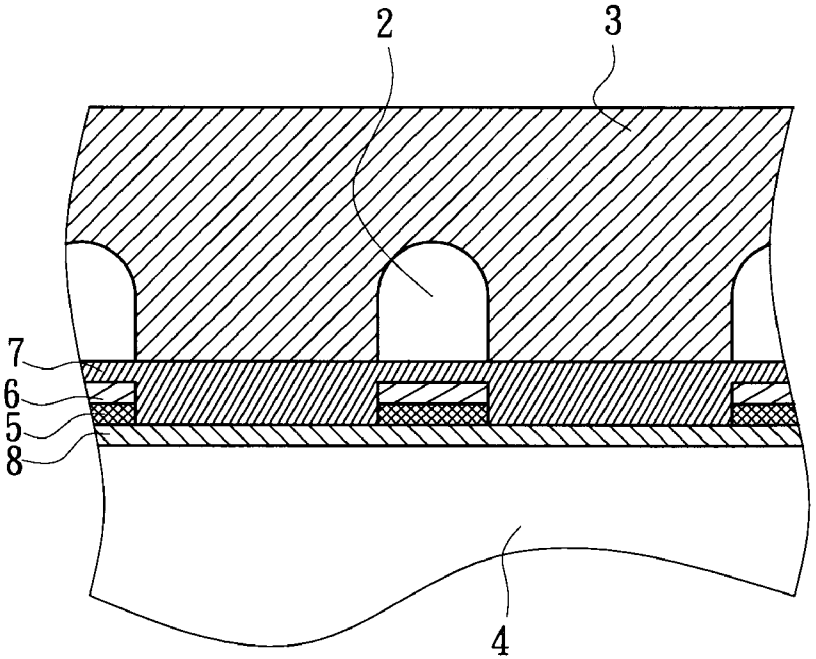
FIGS. 1A and 1B show schematic cross-sectional views of the structure of a conventional side shooting thermal bubble inkjet print head.
Figure 1A:
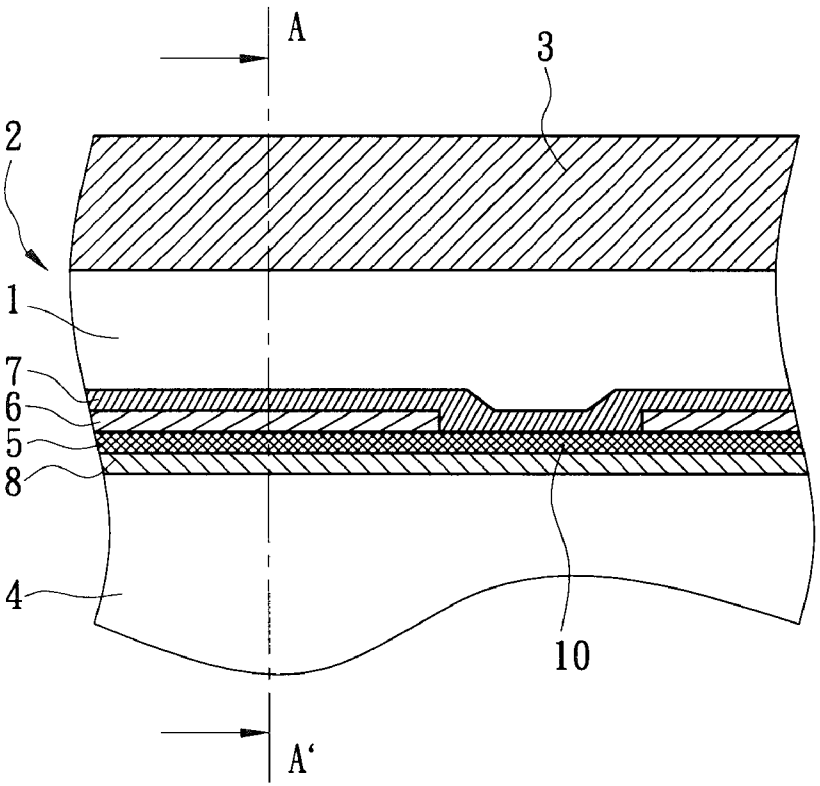
Figure 2B:
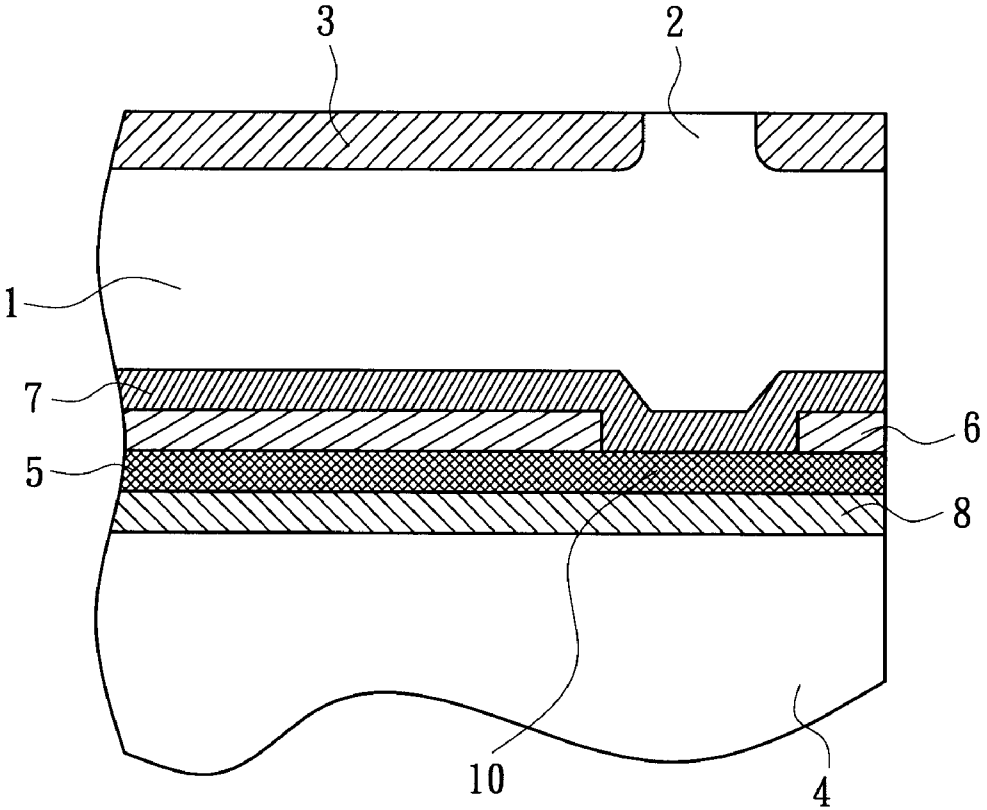
FIGS. 2A and 2B show schematic cross-sectional views of the structure of a conventional roof shooting thermal bubble inkjet print head.
Figure 2A:
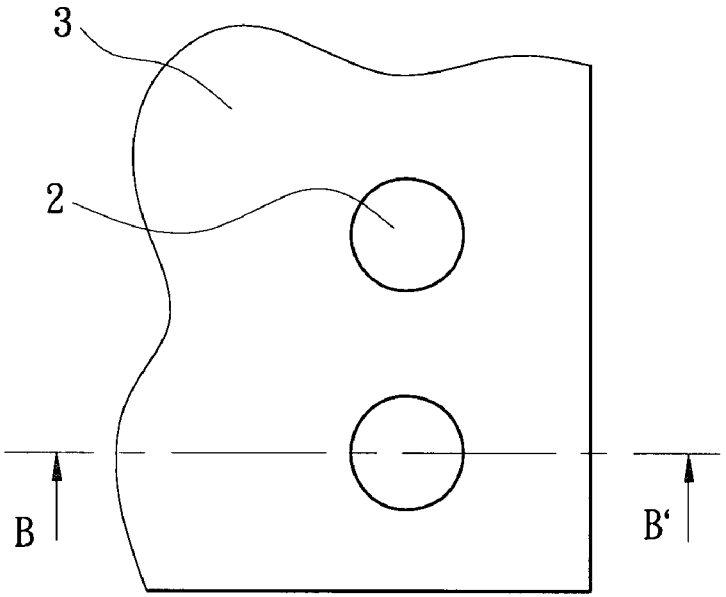
Figure 3A:
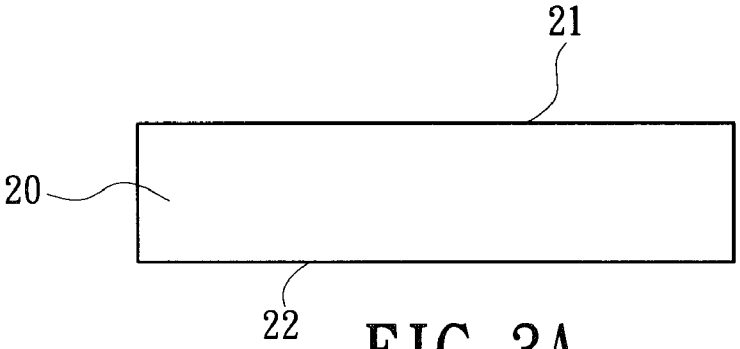
FIGS. 3A through 3M illustrate the manufacturing method of a thermal bubble inkjet print head according to the present invention.
Figure 3B:
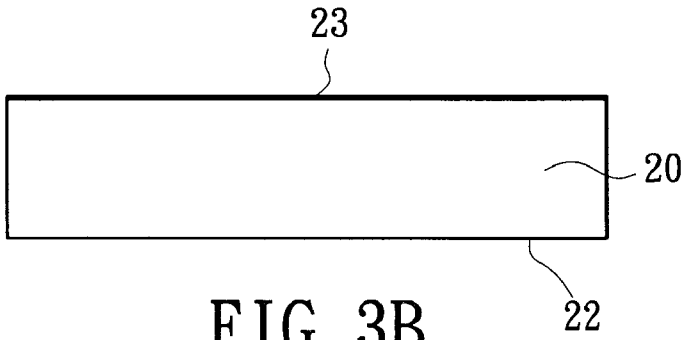
Figure 3C:
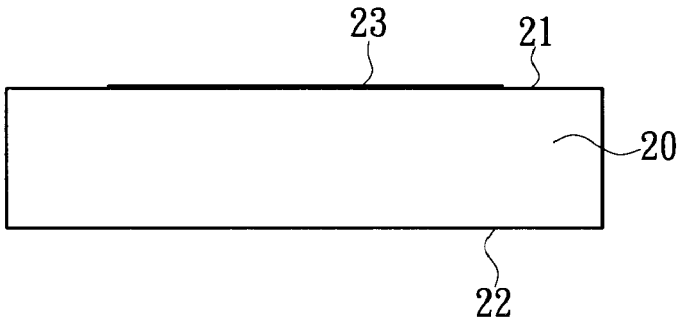
Figure 3D:
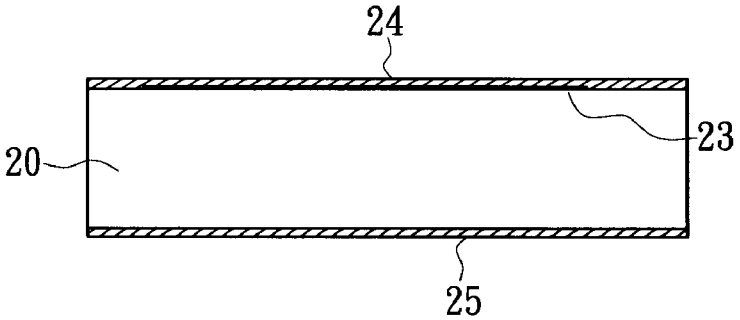

Please refer to FIGS. 3A through 3M and FIGS. 4A and 4B for the disclosed method for making a monolithic integrated thermal bubble inkjet print head. As shown in FIG. 3A, a substrate 20, such as a silicon chip, is provided with a top surface 21 on its top side and a back surface 22 on its back side. As shown in FIG. 3B, the top surface 21 is deposited with a sacrifice layer 23 by, for example, chemical vapor deposition. The sacrifice layer 23 can be polysilicon, amorphous silicon, or aluminum. As shown in FIG. 3C, the sacrifice layer 23 is patternized by etching, e.g., dry etching, to define the pattern for an ink channels. As shown in FIG. 3D, a first protection layer 24 is deposited on the top surface 21 of the substrate 20 and the sacrifice layer 23. A second protection layer 25 is deposited on the back surface 22 of the substrate 20. Both the first protection layer 24 and the second protection layer 25 can be made of materials such as SiC, $SiN_x$, $SiO_2$, $SiO_xN_y$.

Figure 3F:
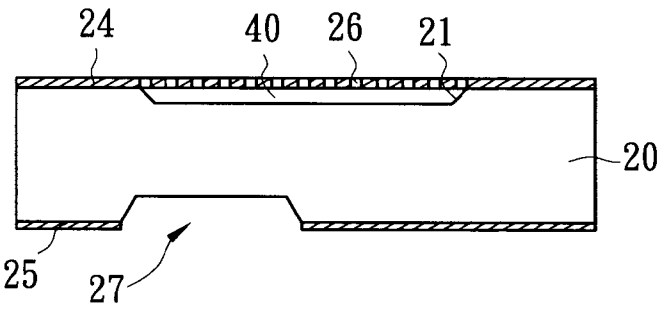
Figure 3H:
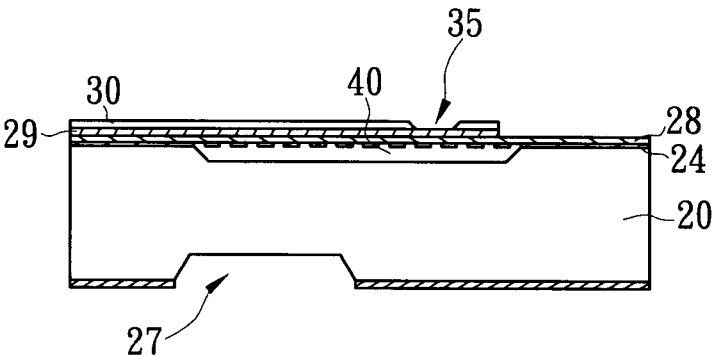
Figure 3E:
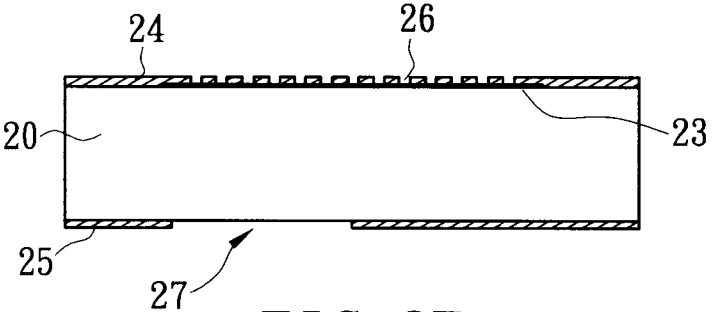
Figure 3G:
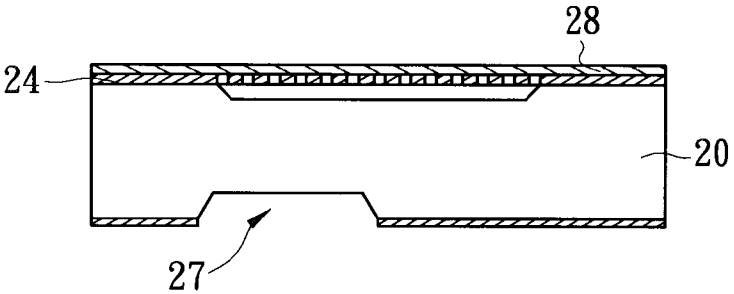

As shown in FIG. 3E, a mesh 26 is formed on the first protection layer 24 of the sacrifice layer 23. The sizes of the mesh holes range from 1 $\mu m^2$ to 9 $\mu m^2$. Furthermore, the second protection layer 25 on the back surface 22 of the substrate is etched to define the size of an ink inlet 27. As shown in FIG. 3F, the top surface 21 of the substrate 20 and the sacrifice layer 23 are etched using the anisotropic etching technology with the mesh 26 as the window for the etching solution (e.g., KOH) to etch downwards so as to form the ink channels 40 on the top surface 21 of the substrate 20. The ink inlet 27 on the back surface 22 of the substrate is etched to form a groove with roughly the same depth as that of the ink channel 40. After the ink channel etching is completed, as shown in FIG. 3G, a planarizing insulation layer 28 is deposited on the first protection layer 24 to fill the mesh 26, obtaining a planar surface. The planarizing insulation layer 28 can be a single- or multiple-film layer structure that is made of $SiN_x$, SiC, $SiO_xN_y$, $Ta_2O_5$, or $SiO_2$.

With reference to FIG. 3H, a layout of a thermal resistor film layer 29 and wires 30 are formed on the planarizing insulation layer 28, e.g. by sputtering and etching technoloies, forming electricity-heat energy transducers 35 at the positions corresponding to the ink channels 40. In this embodiment, the electricity-heat energy transducer is used as an example of the energy transducer; however, other forms of energy transducers can be used. As shown in FIG. 31, an insulation layer 31 is deposited on the to surface of the substrate 20 to protect the wires 30 and the electricity-heat energy transducers 35 from corrosion. The insulation layer 31 can have a single- or multiple-film layer structure made of any combination of $SiN_x$, SiC, $SiO_xN_y$, $Ta_2O_5$, or $SiO_2$ films. Afterwards, at least one ink slot 36 is formed from the ink inlet on the back surface of the substrate 20 through the substrate 20 to the ink channels 40 by anisotropic etching. Preferably, the ink slot 36 connects to front ends 41 of the ink channels 40.

Figure 3J:
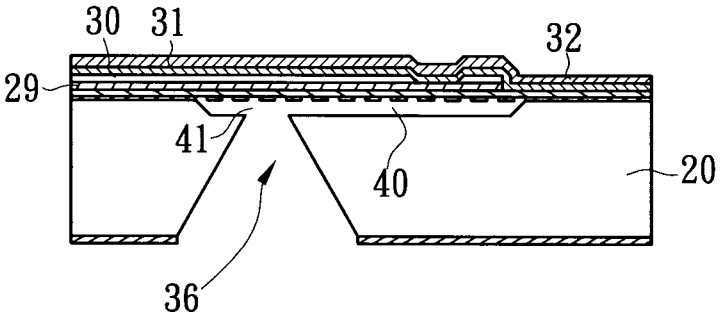
Figure 3L:
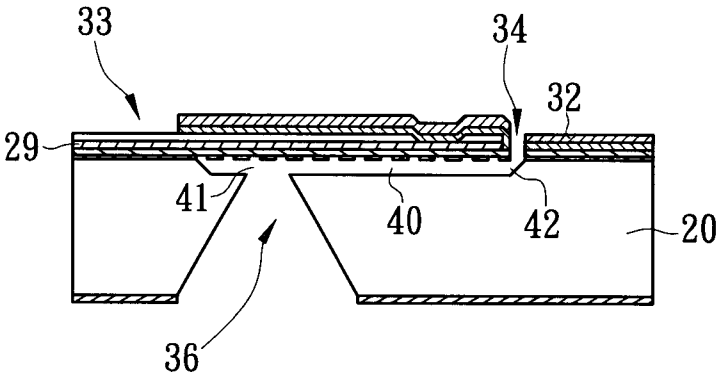
Figure 3I:
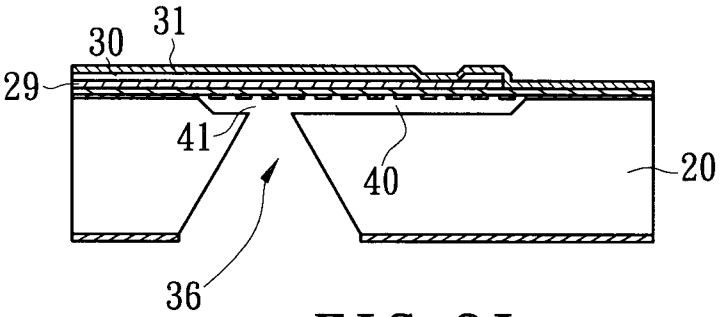
Figure 3K:
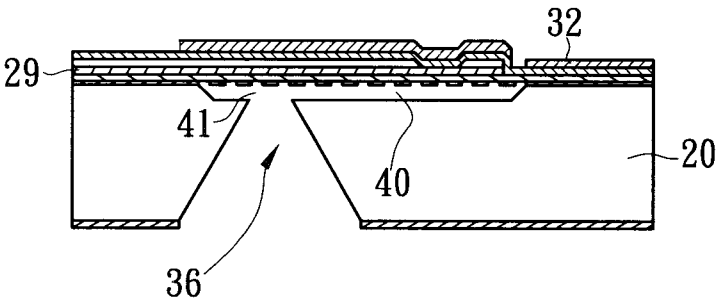
Figure 3M:
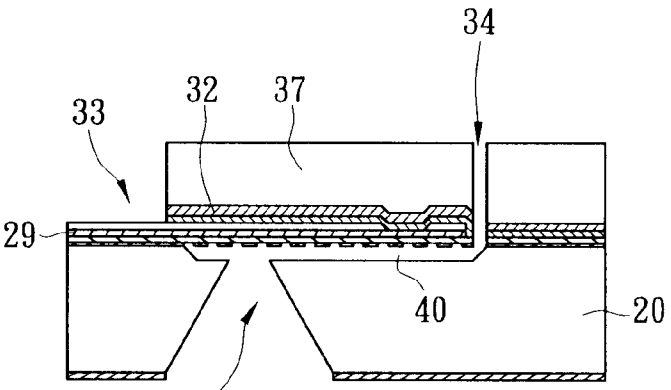

As shown in FIG. 3J, a seed layer 32 is formed on the insulation layer 31. The seed layer 32 can be a single- or multiple-film layer structure made of any combination of Ta, Cr, Au, Ni, Al, Cu, Pd, Pt, Ti, and TiW. As shown in FIG. 3K, the seed layer 32 is etched to define the positions of orifices and the areas of electrical pads. As shown in FIG. 3L, electrical pads 33 and orifices connecting to the ink channels 40 are formed by etching from the top surface of the substrate. The orifices 34 preferably connect to tail ends 42 of the ink channels 40. As shown in FIG. 3M, a metal orifice plate is formed on the seed layer 32 by plating.

Although plating is used to form the orifice plate 37 in the above embodiment, the present invention is, however, not limited by this example. The orifice plate can be a plastic orifice plate formed by other methods such as spin coating or lamination whereby the seed layer 32 is not necessary.

Figure 4B:
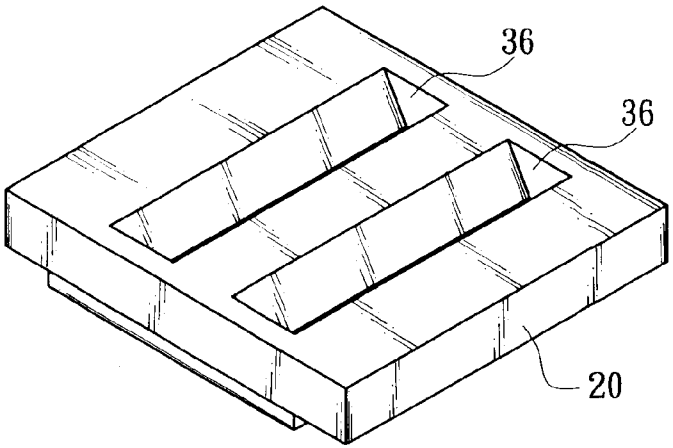
FIG. 4B is a bottom perspective view of a thermal bubble inkjet print head finished according to the present invention.
Figure 4A:
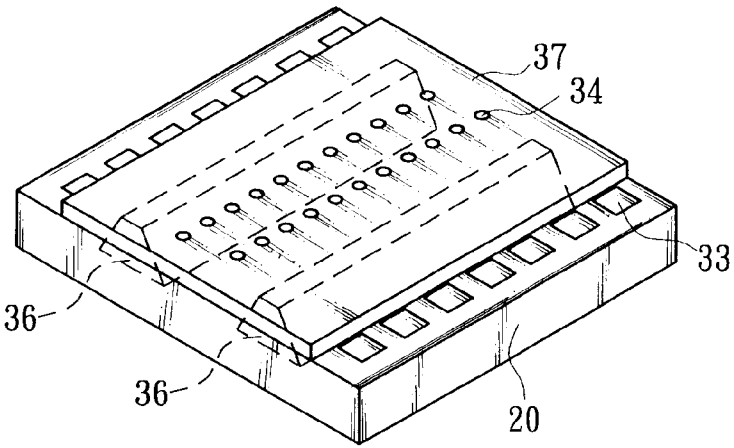
FIG. 4A is a top perspective view of a thermal bubble inkjet print head finished according to the present invention.

With reference to FIG. 4A, one can see the orifice plate 37 formed on the top surface of the substrate 20, the orifices 34 through the orifice plate 37 and, the electrical contact pads 33 exposed. Referring to FIG. 4B, one can see two of the ink slots 36 on the back surface of the substrate 20.

Figure 5A:
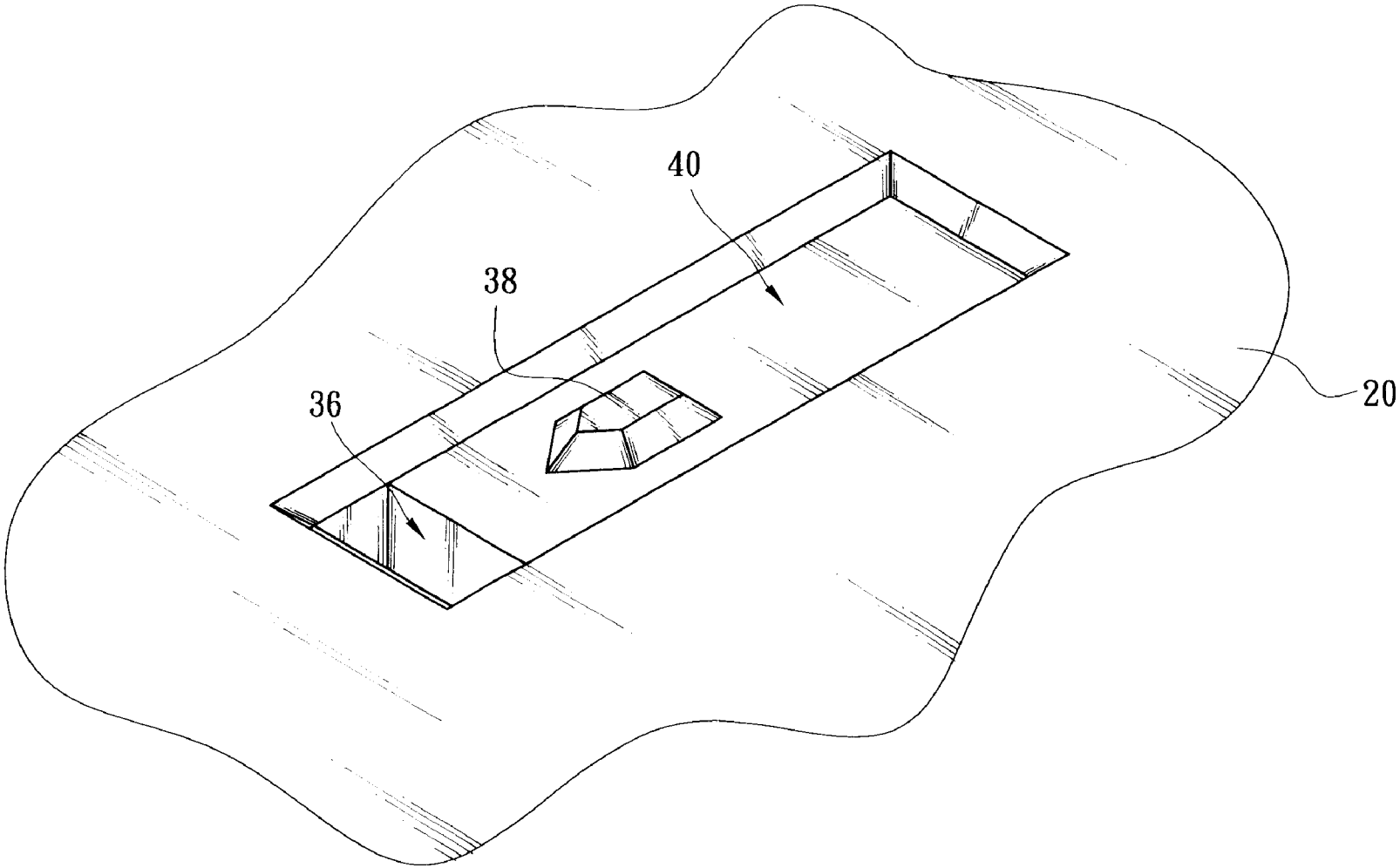
FIG. 5A depicts an ink channel structure of a thermal bubble inkjet print head, wherein an island shape stopper is formed at the bottom of the ink channel.
Figure 5B:
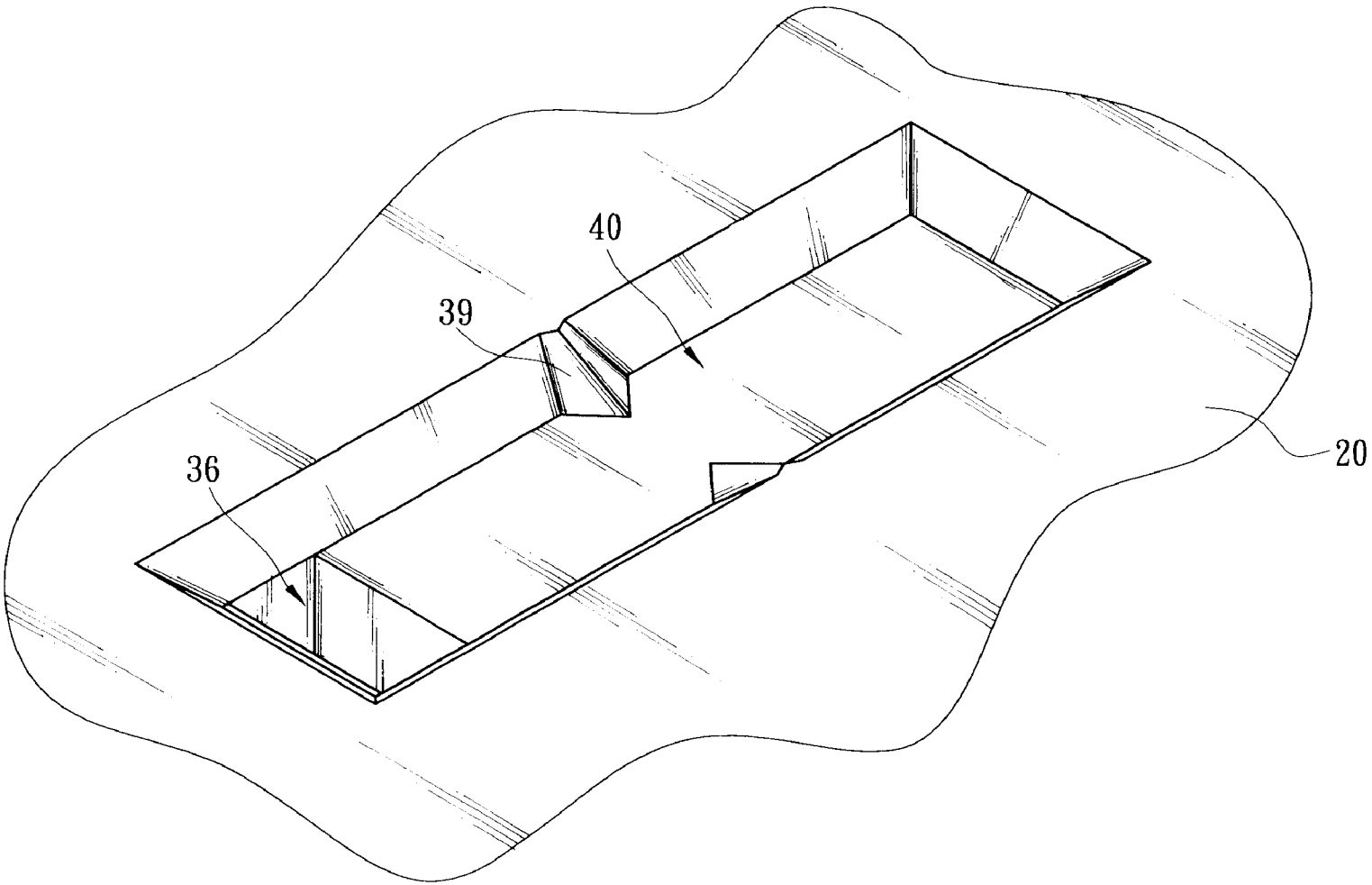
FIG. 5B depicts another ink channel structure of a thermal bubble inkjet print head, wherein a neck shape stopper is formed on both sidewalls of the ink channel.

Each of the ink channels 40 can have a stopper structure to increase the resistance to ink back flow. The structure is between the ink slot 36 and the energy transducer 35. The stopper structure can be a throttle known in the prior art or another structure depicted in FIG. 5A. The bottom of the ink channel 40 has an island type stopper 38. Furthermore, FIG. 5B shows another ink channel structure wherein a neck type stopper is formed on both sidewalls of the ink channel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of making monolithic integrated thermal bubble inkjet print heads that configures each element of the print head on one substrate, comprising the steps of:

forming a first protection layer on a top surface of the substrate and forming a plurality of ink channels between the first protection layer and the substrate by etching;

forming a plurality of energy transducers and proper wires corresponding to the ink channels on the first protection layer and adding an insulation layer for protection;

forming at least one ink slot leading to the ink channel on a back surface of the substrate by etching;

forming proper electrical pads and orifices connecting to the ink channel on the top surface of the substrate by etching; and forming an orifice plate on the top surface of the substrate.

2. The method of claim 1, wherein the step of forming a first protection layer on a top surface of the substrate and forming a plurality of ink channels between the first protection layer and the substrate by etching includes the steps of:

forming a patternized sacrifice layer on the top surface so as to define a pattern for the ink channels;

forming the first protection layer on the top surface and the sacrifice layer and making a mesh on the first protection layer on the sacrifice layer;

forming the ink channels by anisotropically etching the sacrifice layer and the top surface of the substrate; and forming a planarizing insulation layer on the first protection layer to fill the mesh.

3. The method of claim 2, wherein the sacrifice layer is made of polysilicon.

4. The method of claim 2, wherein the sacrifice layer is made of amorphous silicon.

5. The method of claim 2, wherein the sacrifice layer is made of aluminum.

6. The method of claim 2, wherein the sizes of the mesh holes range from 1 $\mu m^2$ to 9 $\mu m^2$.

7. The method of claim 2, wherein the planarizing insulation layer is selected from the group consisting of $SiN_x$, SiC, $SiO_xN_y$, $Ta_2O_5$, and $SiO_2$ films.

8. The method of claim 1, wherein the orifice plate is a plastic orifice plate formed by spin coating.

9. The method of claim 1, wherein the orifice plate is a plastic orifice plate formed by lamination.

10. The method of claim 1, wherein the orifice plate is a metal orifice plate formed by plating.

11. The method of claim 10 further comprising the step of forming a seed layer on the insulation layer before the electrical pads and the orifices are formed.

12. The method of claim 11, wherein the seed layer is selected from the group consisting of Ta, Cr, Au, Ni, Al, Cu, Pd, Pt, Ti, and TiW films.

13. The method of claim 1, wherein the substrate is a silicon substrate.

14. The method of claim 1, wherein the first protection layer is selected from the group consisting of SiC, $SiN_x$, $SiO_2$, and $SiO_xN_y$ films.

15. The method of claim 1 further comprising the step of forming a second protection layer on a back surface of the substrate.

16. The method of claim 15, wherein the second protection layer is selected from the group consisting of SiC, $SiN_x$, $SiO_2$, and $SiO_xN_y$ films.

17. The method of claim 1, wherein the insulation layer is selected from the group consisting of $SiN_x$, SiC, $SiO_xN_y$, $Ta_2O_5$, and $SiO_2$ films.

18. A monolithic integrated thermal bubble inkjet print head structure, which comprises:

a substrate, which has a top surface and a back surface, the top surface having a plurality of concave ink channels in level with the substrate, the back surface being formed with at least one ink slot roughly vertically going through the substrate and connecting to the ink channel for supply ink to the ink channel;

a protection layer, which covers the substrate top surface and the ink channel;

a plurality of energy transducers forming on the protection layer, each of the energy transducers corresponds to one of the ink channels;

an insulation layer covering the protection layer and the energy transducers;

an orifice plate forming on the insulation layer; and a plurality of orifices roughly perpendicularly going through the orifice plate, the insulation layer, and the protection layer, wherein each of the orifices connects to the corresponding ink channel for the ink to be jetted out, and the orifices and the ink slot are positioned on different side of the energy transducers.

19. The structure of claim 18, wherein the substrate is a silicon substrate.

20. The structure of claim 18, wherein the ink channel and the ink slot are formed on the substrate by etching.

21. The structure of claim 18, wherein the orifice plate is a metal orifice plate.

22. The structure of claim 18, wherein the orifice plate is a plastic orifice plate.

23. The structure of claim 18, wherein inside each of the ink channels is formed with a stopper structure for increasing resistance to ink back flow, the stopper structure being between the energy transducer and the ink slot.

24. The structure of claim 23, wherein the back flow stopper structure is an island type stopper at the bottom of the ink channel.

25. The structure of claim 23, wherein the back flow stopper structure is a neck type stopper on both sidewalls of the ink channel.

26. The structure of claim 18, wherein the energy transducers are electricity-heat energy transducers composed of a properly patterned thermal resistor layer and wires.

* * * * *